US008056386B2

(12) United States Patent
Ou et al.

(10) Patent No.: US 8,056,386 B2
(45) Date of Patent: Nov. 15, 2011

(54) PIN BENDING DEVICE

(75) Inventors: Chun-Nan Ou, Taipei Hsien (TW); Bin Wang, Shenzhen (CN); Cheng-Bin Su, Shenzhen (CN); Jian-Long Xing, Shenzhen (CN); Ga-Lei Hu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 784 days.

(21) Appl. No.: 12/177,835

(22) Filed: Jul. 22, 2008

(65) Prior Publication Data

US 2009/0266136 A1 Oct. 29, 2009

(30) Foreign Application Priority Data

Apr. 28, 2008 (CN) ..... 2008 1 0301366

(51) Int. Cl.
*B21D 9/14* (2006.01)
*B21F 45/00* (2006.01)

(52) U.S. Cl. ..... 72/386; 140/71 R

(58) Field of Classification Search ..... 72/296, 72/308, 311, 316, 386, 387; 140/71 R, 71.5, 140/105, 147; 29/33.2, 766; 57/311
See application file for complete search history.

(56) References Cited

U.S. PATENT DOCUMENTS

| | | | | |
|---|---|---|---|---|
| 4,387,500 | A * | 6/1983 | Weresch | 140/105 |
| 4,895,189 | A * | 1/1990 | Alemanni | 140/147 |
| 6,016,852 | A * | 1/2000 | Mallik et al. | 140/105 |

FOREIGN PATENT DOCUMENTS

| | | |
|---|---|---|
| CN | 2872678 Y | 2/2007 |
| JP | 11-135227 A | 5/1999 |
| TW | 271900 | 3/1996 |
| TW | 516691 | 1/2003 |

* cited by examiner

*Primary Examiner* — Teresa Ekiert
(74) *Attorney, Agent, or Firm* — Altis Law Group, Inc.

(57) ABSTRACT

An exemplary pin bending device (200) includes a base (210), a sliding member (230), a fixing member (240), and a latch member (250). The sliding member (230) is slidably positioned on the base and defines a plurality of holes (2303) for receiving first portions of pins. The fixing member is fixed on the base. The latch member is movably positioned on the base. The latch member is able to move towards the fixing member in a direction perpendicular to the sliding direction of the sliding member and engage with the fixing member to fix second portions of the pins.

8 Claims, 8 Drawing Sheets

PIN BENDING DEVICE

BACKGROUND OF THE INVENTION

1. Field of the Invention

The present invention relates to a pin bending device.

2. Description of the Related Art

An electronic device, such as a fax machine, generally includes a main board, a transmitter optical sub-assembly, and a receiver optical sub-assembly. The transmitter optical sub-assembly and the receiver optical sub-assembly are fixed on the main board.

Generally, a transmitter optical sub-assembly includes a main body and a plurality of pins positioned on the main body. The pins generally need to be bended to position the transmitter optical sub-assembly on the main board.

Generally, the pins are bended by a forceps, however, a force applied on the forceps varies easily, as a result, bending sizes of the pins are difficult to be controlled.

Therefore, a pin bending device is desired in order to overcome the above-described shortcoming.

SUMMARY

A pin bending device includes a base, a sliding member, a fixing member, and at least one latch member. The sliding member is slidably positioned on the base and defines a plurality of holes therein for receiving first portions of pins. The fixing member is fixed on the base. The at least one latch member is movably positioned on the base. The at least one latch member is able to move towards the fixing member in a direction perpendicular to the sliding direction of the sliding member and engage with the fixing member to fix second portions of the pins.

Other advantages and novel features will become more apparent from the following detailed description of various embodiments, when taken in conjunction with the accompanying drawings.

BRIEF DESCRIPTION OF THE DRAWINGS

The components in the drawings are not necessarily drawn to scale, the emphasis instead being placed upon clearly illustrating the principles of the present pin bending device. Moreover, in the drawings, like reference numerals designate corresponding parts throughout several views, and all the views are schematic.

DETAILED DESCRIPTION OF THE PREFERRED EMBODIMENT

Reference will now be made to the drawings to describe a preferred embodiment of the present pin bending device in detail.

Figure 1:
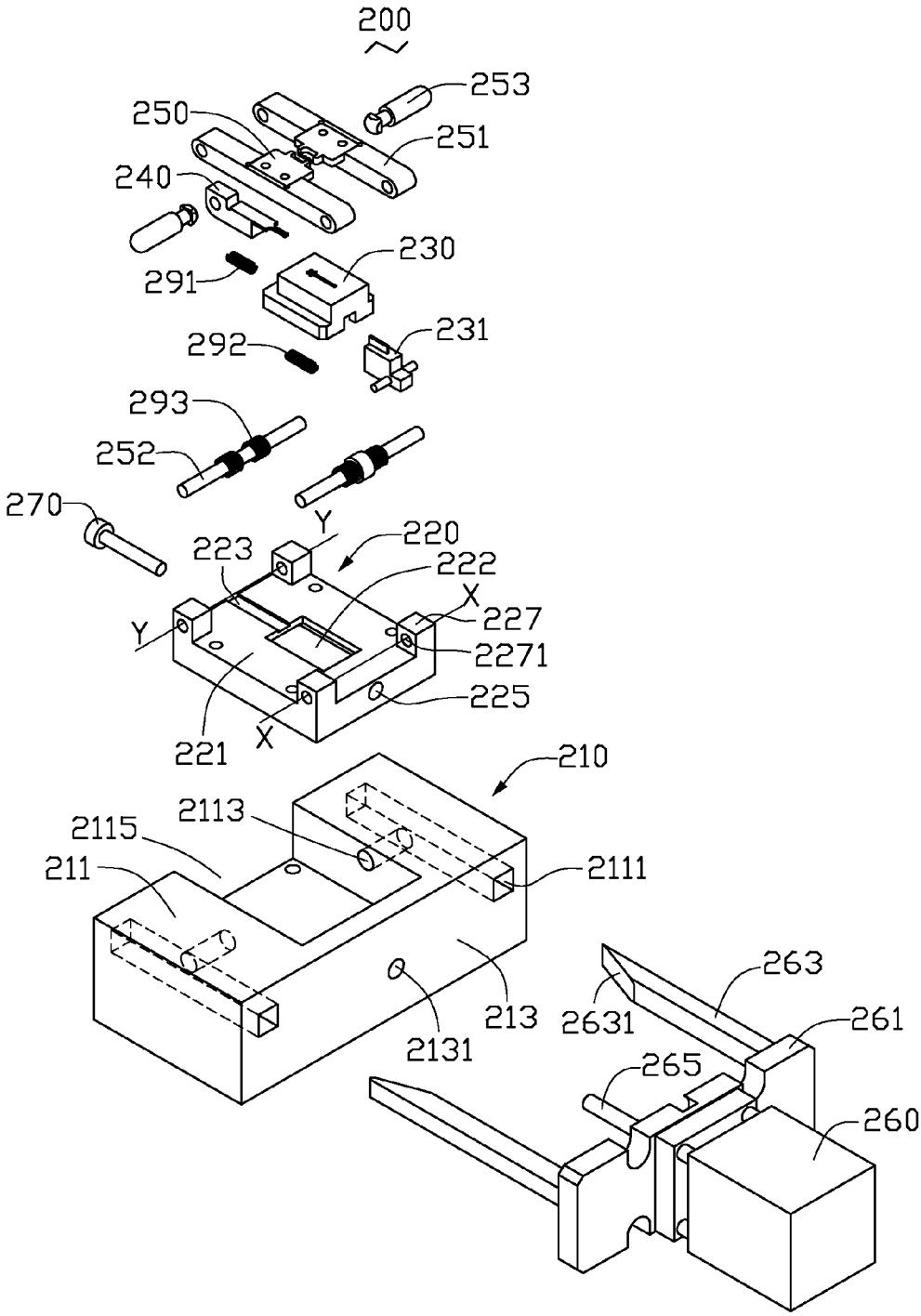
FIG. 1 is an exploded, isometric view of a pin bending device in accordance with a preferred embodiment of the present invention.
Figure 2:
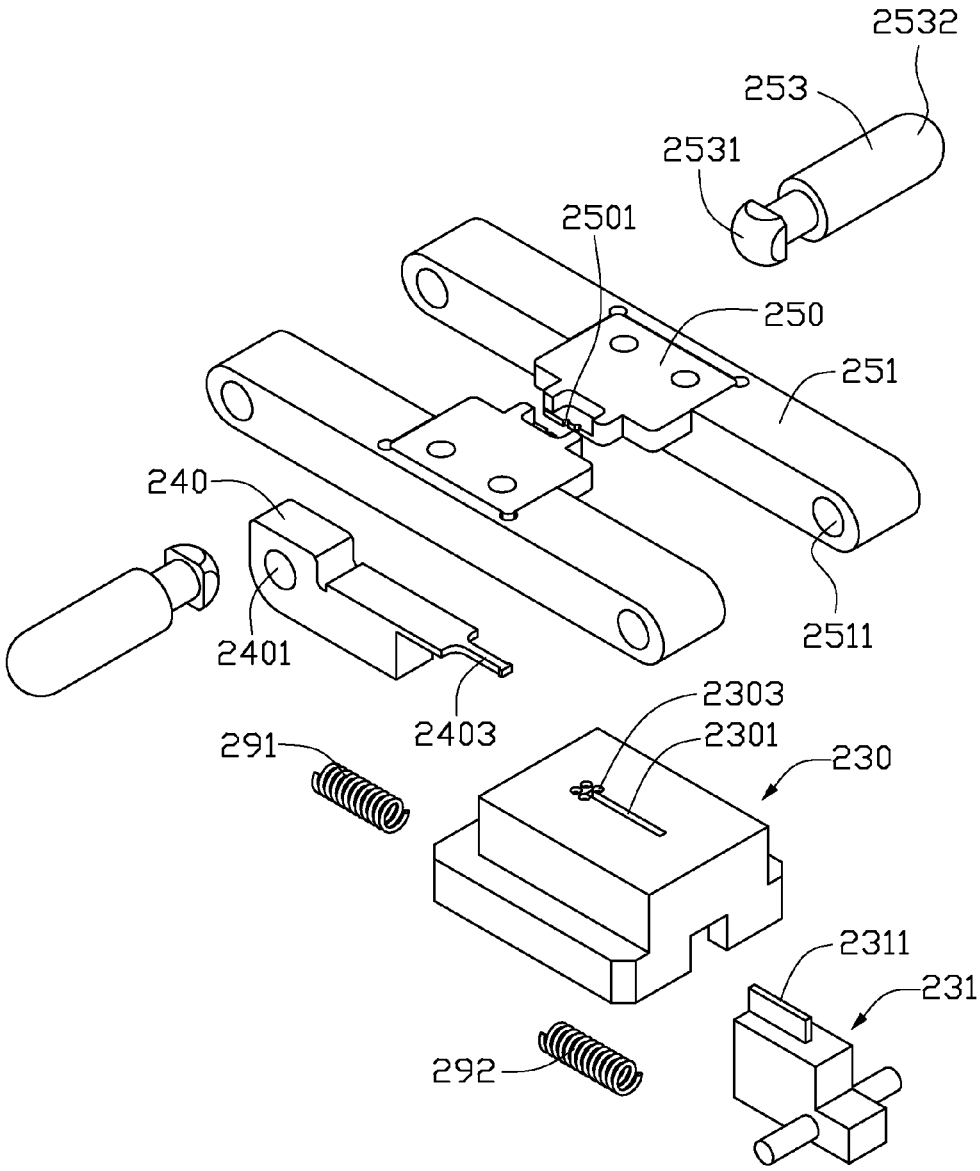
FIG. 2 is a partially enlarged view of the pin bending device in FIG. 1.

Referring to FIGS. 1 and 2, a pin bending device 200 of the preferred embodiment is shown. The pin bending device 200 includes a base 210, a support body 220, a sliding member 230, a resisting member 231, a fixing member 240, two latch members 250, two frames 251, two guide posts 252, two resisting posts 253, a cylinder 260, a connecting board 261, two resisting rods 263, a push rod 265, a screw 270, and a plurality of springs 291, 292, 293.

The base 210 is a substantially rectangular block. The base 210 includes two elongated protrusions 211 and a stopper board 213. The two elongated protrusions 211 face each other. The stopper board 213 connects the two elongated protrusions 211. Two guide holes 2111 and 2113 are defined in each elongated protrusion 211. The guide holes 2111 and 2113 extend into the elongated protrusions 211. The extending direction of the guide holes 2111 is parallel to the longitudinal direction of the elongated protrusions 211. The extending direction of the guide holes 2113 is perpendicular to the longitudinal direction of the elongated protrusion 211. A cylindrical axis of the guide hole 2113 is substantially coplanar with a cylindrical axis of guide hole 2111. The guide holes 2113 communicate with the guide holes 2111 correspondingly. The stopper board 213 further defines a through hole 2131. The extending direction of the through hole 2131 is parallel to the extending direction of the guide hole 2111. The elongated protrusions 211, the stopper board 213, and other parts of the base 210 cooperatively define a receiving groove 2115.

The support body 220 is a substantially rectangular block. The support body 220 is configured to be receivable in the receiving groove 2115. A rectangular depression 222, a screw groove 223, and a guide hole 225 are defined in the support body 220. The depression 222 is in a surface 221 of the support body 220. The screw groove 223 and the guide hole 225 are located on opposite sides of the depression 222. The screw groove 223 and the guide hole 225 communicate with the depression 222. In addition, the support body 220 also includes four protrusions 227 correspondingly formed adjacent four corners of the surface 221. A circular through hole 2271 is defined in each protrusion 227. Two of the through holes 2271 on a side of the support body 220 and adjacent the guide hole 225 are aligned and have coaxial cylindrical axes X-X, another two of the through holes 2271 on the opposite side of the support body 220 are also aligned and have coaxial cylindrical axes Y-Y. In addition, the axes X-X, Y-Y are perpendicular to the extending direction of the screw groove 223.

The sliding member 230 is a substantially rectangular block, and is configured to be receivable in the depression 222. A guide slot 2301 and two rows of holes 2303 are defined in a central portion of the sliding member 230. The holes 2303 of each row are aligned along a same single axis. The two single axes are located on two sides of the guide slot 2301 and are parallel to the guide slot 2301.

The resisting member 231 forms a protrusion 2311 configured for engaging with the guide slot 2301.

One end of the fixing member 240 defines a through hole 2401 and the other end of the fixing member 240 forms a fixing portion 2403. The width of the fixing portion 2403 is substantially equal to the distance between the two rows of the holes 2303.

Each latch member 250 is a substantially rectangular block. Each latch member 250 defines a plurality of latch notches 2501 in a side of the latch member 250. Each latch notch 2501 is semi-circular in shape and a diameter of the latch notch 2501 is substantially equal to that of each pin.

The frames 251 are elongated. Two through holes 2511 are defined in each frame 251, adjacent to the two ends thereof. The extending direction of the through holes 2511 is perpendicular to a longitudinal direction of the frame 251.

Each resisting post 253 is substantially a cylinder. Each resisting post 253 forms two resisting portions 2531 and 2532 at its two ends respectively.

The resisting rods 263 are elongated. One end of each resisting rod 263 forms a slanted surface 2631.

Figure 3:
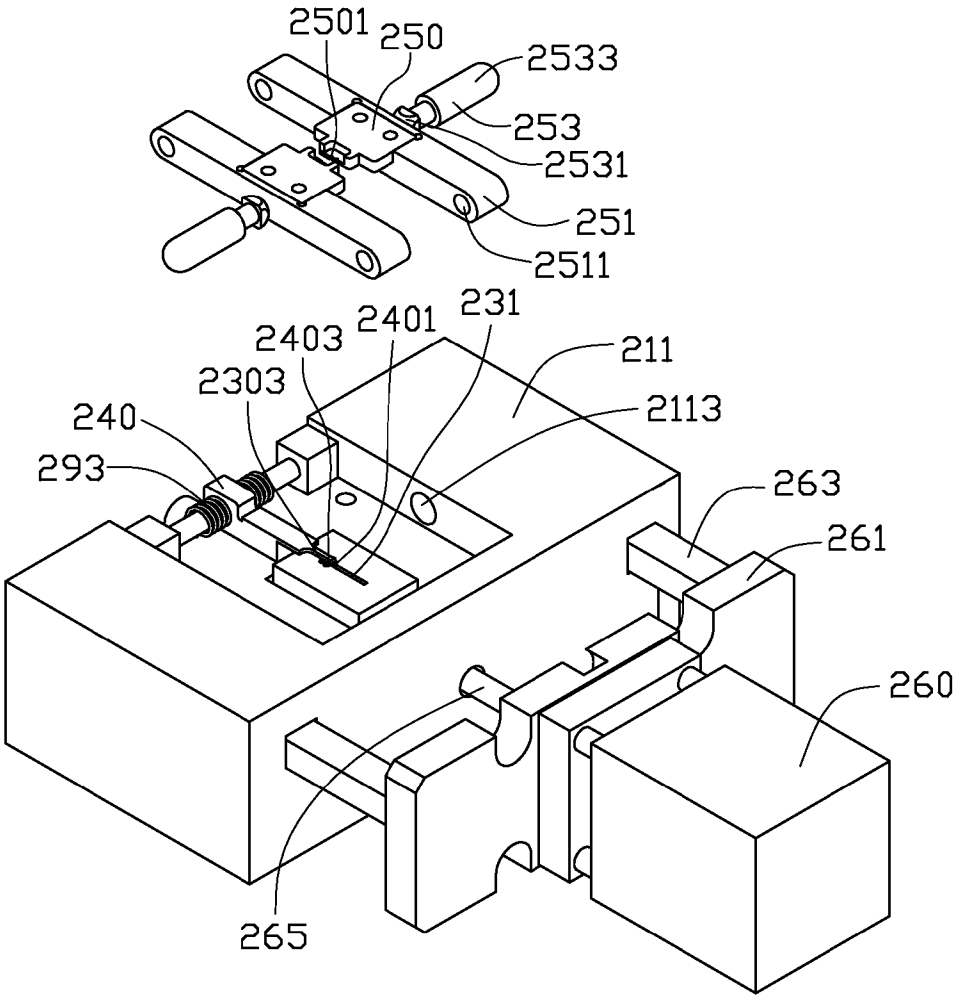
FIG. 3 is a partial, assembled view of the pin bending device in FIG. 1.
Figure 4:
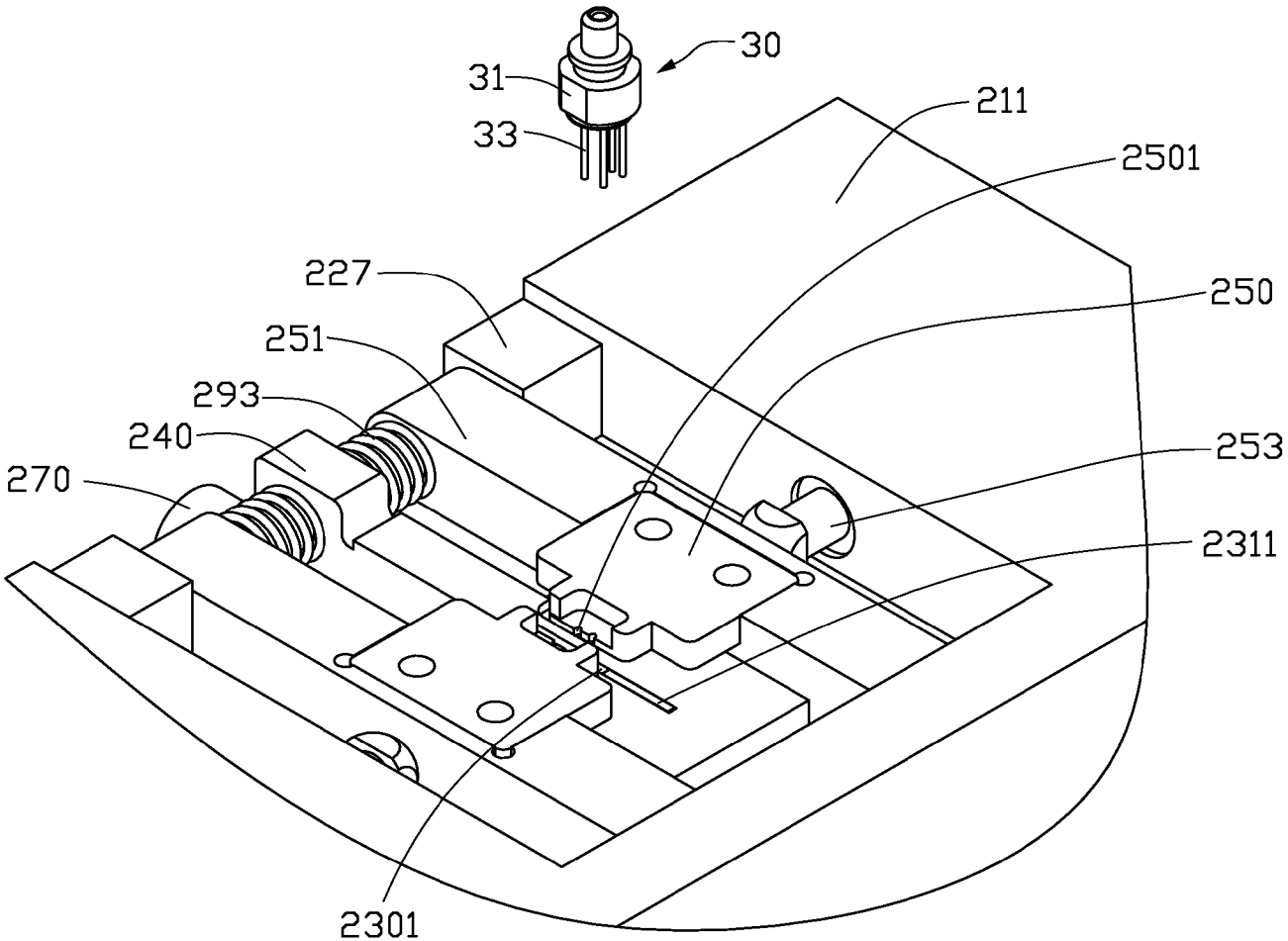
FIG. 4 is a partially enlarged, assembled view of the pin bending device in FIG. 1.
Figure 5:
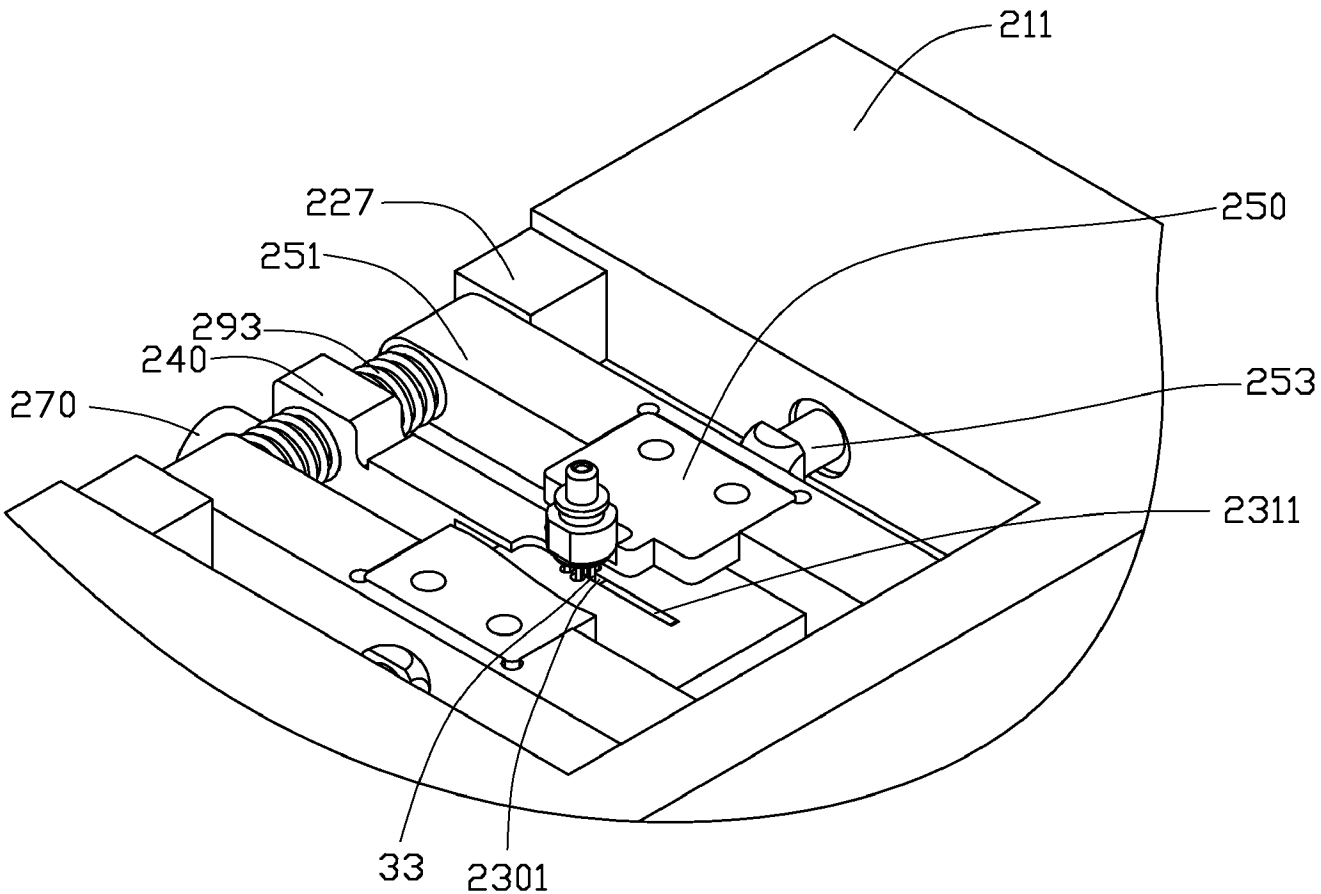
FIG. 5 is a partially enlarged, isometric view of the pin bending device in FIG. 1, when a plurality of pins of an optical sub-assembly are inserted into a plurality of holes of a sliding member of the pin bending device.
Figure 6:
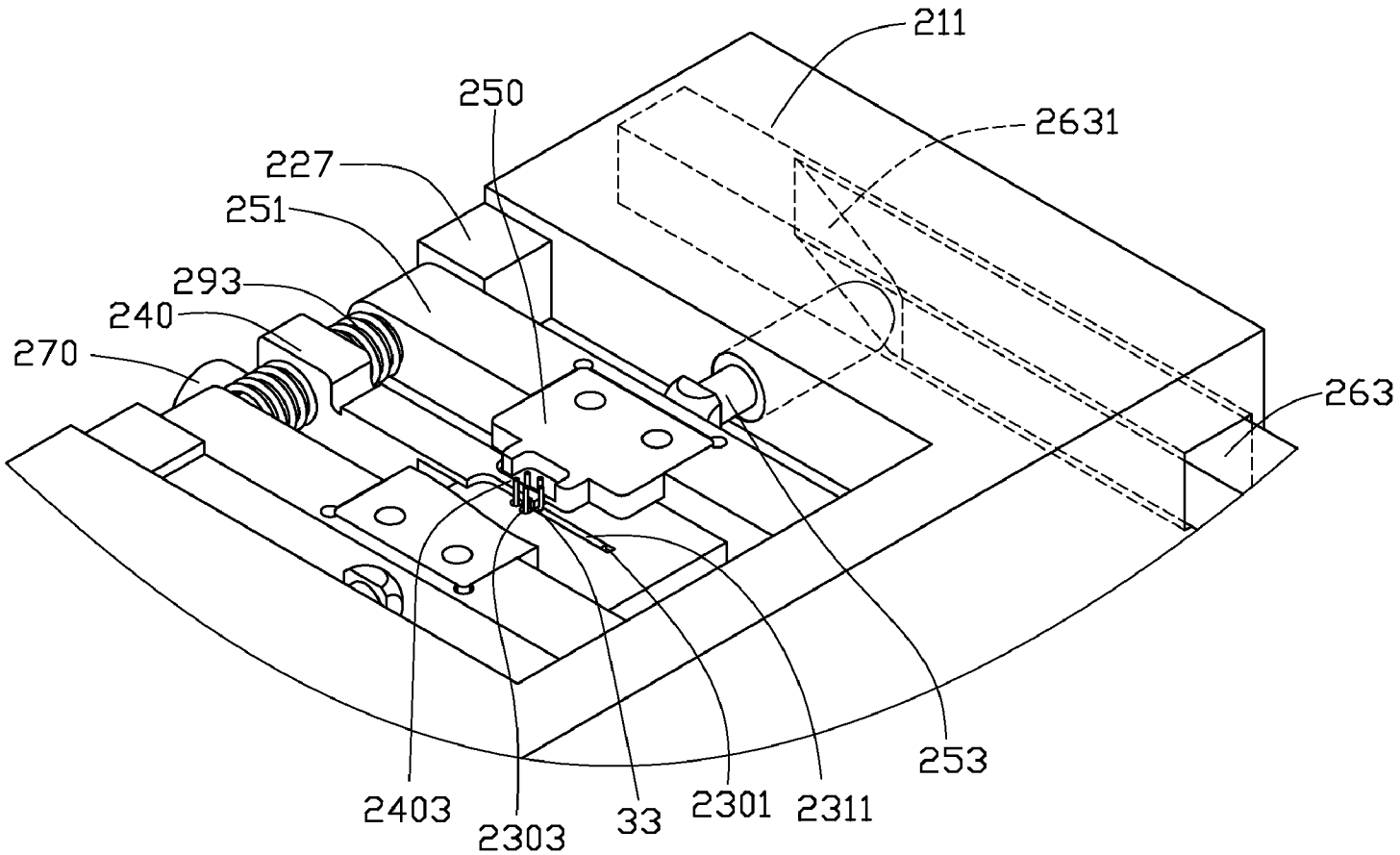
FIG. 6 is a partially enlarged, isometric view of the pin bending device in FIG. 1, when one of the pins is being bended.
Figure 7:
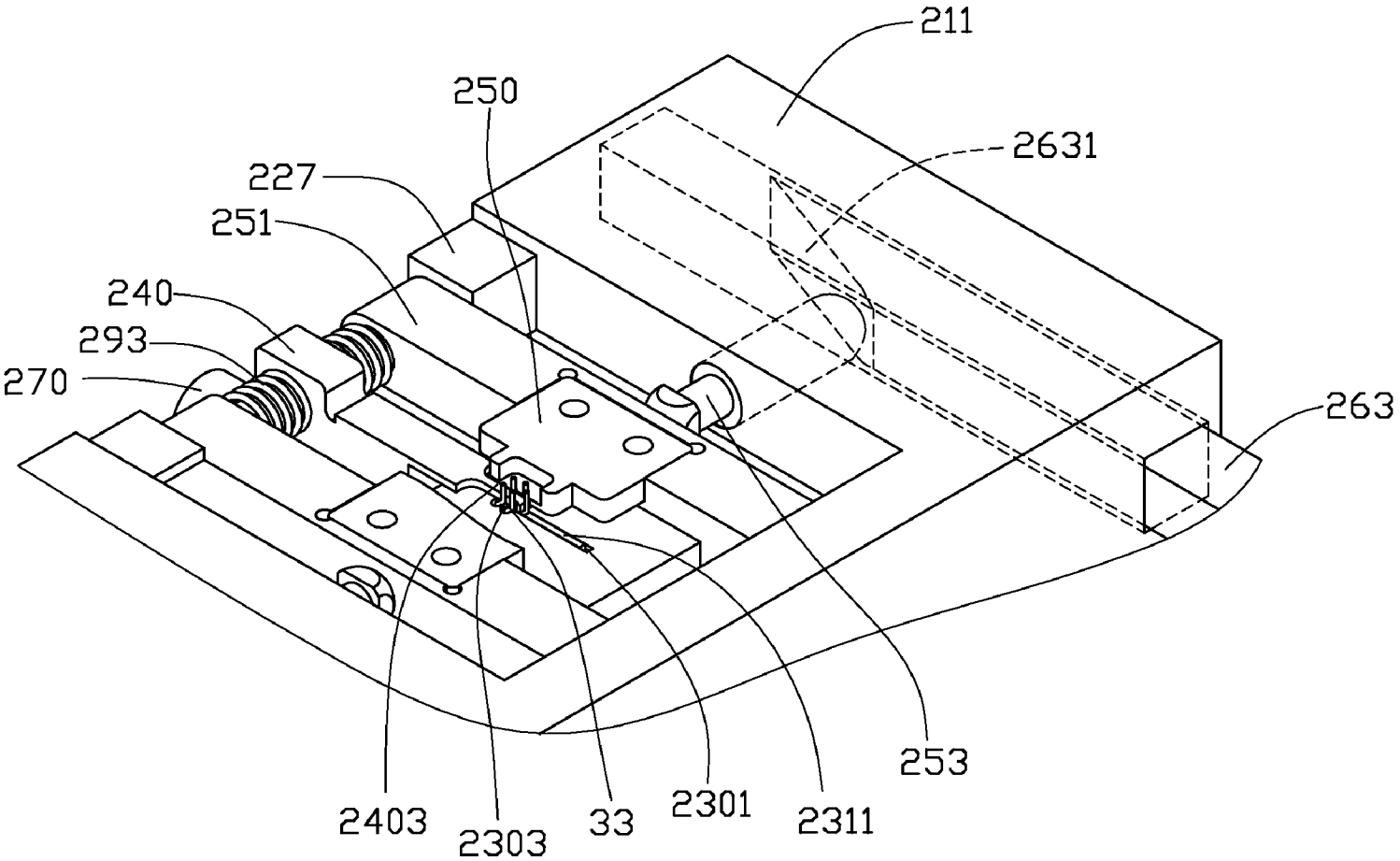
FIG. 7 is a partially enlarged, isometric view of the pin bending device in FIG. 1, when all pins are being bended by the pin bending device.

Referring to FIGS. 3 and 4, to assemble the pin bending device 200, the following steps are provided.

First step, the protrusion 2311 is passed through the guide slot 2301. Then the sliding member 230 and the resisting member 231 are slidably positioned in the depression 222. One end of the spring 292 resists the resisting member 231 and the other end of the spring 292 resists the sliding member 230. One end of the springs 291 resists the support body 220 and the other end of the springs 291 resists the sliding member 230. As a result, the sliding member 230 is slidable along a bottom surface of the depression 222 relative to the support body 220. The resisting member 231 is slidable along the bottom surface of the depression 222 relative to the support body 220 and the sliding member 230. Additionally, after the sliding member 230 and the resisting member 231 slide in the depression 222, and the force applied on the resisting member 231 is released, the springs 291, 292 push the sliding member 230 and the resisting member 231 to slide to their original positions respectively.

Second step, the fixing portion 2403 is positioned in a space defined by the two rows of the holes 2303. The through holes 2511 are aligned with the through holes 2271 correspondingly, the corresponding guide posts 252 are passed through the through holes 2511 and the through holes 2271 correspondingly such that the frames 251 are slidably positioned on the guide posts 252. In addition, one guide post 252 is passed through the through hole 2401 such that the fixing member 240 is fixed to the corresponding guide post 252. The springs 293 are sleeved on the resisting posts 253 and configured to resist the frames 251. Each latch member 250 is fixed on a side of the frame 251 correspondingly such that the latch notches 2501 face the fixing member 240.

Third step, each resisting post 253 is inserted into the corresponding guide hole 2113. After that, the support body 220 is placed into the receiving groove 2115 with such manner that the axes X-X, Y-Y of the through holes 2271 are perpendicular to the elongated protrusion 211 and the resisting portions 2531 resist the frames 251.

Fourth step, one end of the push rod 265 is fixed on the connecting board 261 and the other end of the push rod 265 is passed through the through hole 2131, the guide hole 225, and is finally connected to the resisting member 231. Simultaneously, one end of the resisting rods 263 is fixed on the connecting board 261, and the other end of the resisting rods 263 is passed through the corresponding guide hole 2111. Then the slanted surfaces 2631 resist the resisting portions 2532. One end of the screw 270 rotatably engages in the screw groove 223 and the other end of the screw 270 resists the sliding member 230. Thus, the pin bending device 200 is achieved.

Also referring to FIGS. 4 through 7, during operation, a receiver optical sub-assembly 30 is provided, the receiver optical sub-assembly 30 includes a main body 31 and a plurality of pins 33 positioned on the main body 31.

End portions of the pins 33 are inserted into the holes 2303 correspondingly such that the end portions of the pins 33 are fixed. The cylinder 260 pushes the connecting board 261, and, as a result, the connecting board 261 pushes the resisting rods 263 and the push rod 265. The push rod 265 first drives the resisting member 231 such that the protrusion 2311 resists one of the pins 33 (hereinafter referred to as the pin 33*a*), then the protrusion 2311 and the fixing portion 2403 forms a force to the pin 33*a*, as a result, the pin 33*a* becomes bended.

After the pin 33*a* is bended, the push rod 265 continues moving and driving the resisting member 231, such that the protrusion 2311 resists the pin 33*a* continuously, then the resisting member 231 pushes the sliding member 230. The sliding member 230 moves along a direction parallel to the fixing member 240 and the latch members 250 due to a force from the resisting member 231. Simultaneously, the slanted surfaces 2631 drive the resisting posts 253, the resisting posts 253 drive the frames 251 to move towards the fixing member 240. Thus the latch members 250 move towards the fixing member 240 in a direction perpendicular to the sliding direction of the sliding member 230 and engage with the fixing member 240, the middles of the pins 33 are received in the latch notches 2501 partially and are fixed to the latch members 250 and the fixing member 240. As a result, the sliding member 230, the fixing member 240, and the latch members 250 form a force that acts on a boundary of the end potions and the middles of the pin 33*a* and other pins 33 such that all the pins 33 are bended. Additionally, the pin 33*a* has a larger bending size relative to other the pins 33.

Figure 8:
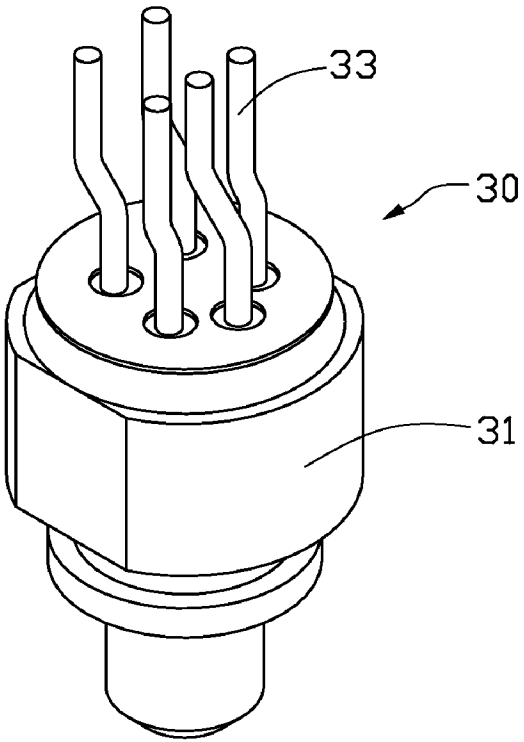
FIG. 8 is an isometric view of a transmitter optical sub-assembly, of which the pins are bended.

After the force that the cylinder 260 applies to the connecting board 261 is released, the connecting board 261 pulls back the resisting rods 263 and the push rod 265. As a result, the slanted surfaces 2631 are released from the resisting posts 253. Then, each frame 251 slides along the corresponding guide post 252 away the fixing member 240 due a force of the springs 293 such that the latch members 250 are unlatched from the fixing member 240. Therefore, a receiver optical sub-assembly 30 shown in FIG. 8 with pins 33 bended can be directly taken off the sliding member 230.

In addition, when the resisting member 231 pushes the sliding member 230 and the sliding member 230 moves, the springs 291 become compressed by the sliding member 230 and the support body 220, the springs 292 become compressed by the sliding member 230 and the resisting member 231. When the force that the cylinder 260 exerts on the connecting board 261 is released, the springs 291 and 292 push the sliding member 230 and the resisting member 231 to slidably return to their original positions respectively.

In the above mentioned bending process, the distance that the sliding member 230 moves relative to the fixing member 240 and the latch members 250 can be a constant value. Therefore, bending size of the pins 33 can be controlled precisely. Additionally, the distance of the movement of the sliding member 230 can be adjusted to process different receiver optical sub-assemblies with different bending size of the pins.

When the receiver optical sub-assembly 30 has an odd number of pins and a bending size of one of the pins is required to be larger than others, the resisting member 231 is necessary. In that configuration, the push rod drives the resisting member to push the sliding member such that the push rod resists the sliding member indirectly. When the receiver optical sub-assembly 30 has an even number of pins, the resisting member 231 can be omitted, and the push rod 265 can be configured to resist the sliding member 230 directly.

The springs 293, the resisting posts 253, and the resisting rods 263 may also be replaced by other push modules such as cylinder, electronic motor.

The latch notches 2501 also can be defined in either of a side of the fixing member 240 and a side of the latch members 250. Additionally, a shape of each latch notch 2501 also can be other shapes such as a square, triangle, and polygon.

The cylinder 260, the connecting board 261, and the resisting rods 263 can be omitted. In addition, the support body 220 can also be omitted. In this configuration, the sliding member 230 can be slidably positioned on the base 210 directly. The fixing member 240 can be fixed on the base 210 directly. The latch member 250 can be movably positioned on the base 210 directly.

It can be understood that, the above mentioned pin bending device 200 can be used to bending pins of other electronic component such as a connector.

Finally, while various embodiments have been described and illustrated, the invention is not to be construed as being limited thereto. Various modifications can be made to the embodiments by those skilled in the art without departing from the true spirit and scope of the invention as defined by the appended claims.

What is claimed is:

1. A pin bending device, comprising:

a base;

a sliding member slidably positioned on the base and defining a plurality of holes therein for receiving first portions of pins;

a fixing member positioned on the base; and two latch members movably positioned on the base, the two latch members being able to move towards the fixing member in a direction perpendicular to a sliding direction of the sliding member and engaging with the fixing member to fix second portions of the pins;

wherein at least one side of each latching member defines a plurality of latch notches configured for receiving the pins partially when the fixing member engages with the latch member; the two latch members are located on opposite sides of the fixing member correspondingly.

2. The pin bending device as claimed in claim 1, wherein the pin bending device includes a push module configured for controlling a movement of the latch members.

3. The pin bending device as claimed in claim 2, wherein the push module includes two springs, two resisting posts, and two resisting rods, each resisting rod forms a slanted surface; a first spring is located between a first latch member and the fixing member and a second spring is located between another first latch member and the fixing member; a first resisting rod is located between the first latch member and the fixing member and a second resisting rod is located between a second latch member and the fixing member; and one end of the springs resists the fixing member and the other end of the spring resists the latch members, one end of the resisting posts resists the latch members and the other end of the resisting posts resists the slanted surfaces of the resisting rods.

4. The pin bending device as claimed in claim 3, wherein the pin bending device further includes a support body positioned on the base, two guide posts, and two frames, the support body forms four protrusions, the sliding member and the fixing member are positioned on the support body, each frame defines two through hole in two ends of the frame respectively, and the guide posts are passed through the corresponding through holes of the frames and ends of the guide posts are positioned on the corresponding protrusions of the support body.

5. The pin bending device as claimed in claim 4, wherein the base forms two elongated protrusions, each elongated protrusion defines a first guide hole and a second guide hole, the first guide hole is perpendicular to and communicates with the second guide hole, the resisting posts are received in the first guide holes, the resisting rods are received in the second guide holes.

6. The pin bending device as claimed in claim 3, wherein the pin bending device further includes a cylinder, a connecting board, and a push rod, the connecting board connects the cylinder, the resisting rods are positioned on the connecting board, one end of the push rod is positioned on the connecting board and the other end of the push rod resists the sliding member.

7. The pin bending device as claimed in claim 6, wherein the pin bending device includes a resisting member, the sliding member defines a guide slot adjacent to the holes, the resisting member is slidably received in the guide slot of the sliding member, the push rod drives the resisting member to push the sliding member such that the push rod resists the sliding member indirectly.

8. The pin bending device as claimed in claim 1, wherein the pin bending device includes a screw configured for resisting the sliding member.

* * * * *